US010990060B2

(12) United States Patent
Ashikagaya et al.

(10) Patent No.: US 10,990,060 B2
(45) Date of Patent: Apr. 27, 2021

(54) FIXING DEVICE AND IMAGE FORMING APPARATUS INCORPORATING SAME

(71) Applicants: Atsushi Ashikagaya, Kanagawa (JP); Masashi Ohi, Kanagawa (JP); Junichi Sasaki, Kanagawa (JP); Yasunobu Kidoura, Kanagawa (JP); Yuuto Akiba, Kanagawa (JP)

(72) Inventors: Atsushi Ashikagaya, Kanagawa (JP); Masashi Ohi, Kanagawa (JP); Junichi Sasaki, Kanagawa (JP); Yasunobu Kidoura, Kanagawa (JP); Yuuto Akiba, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/787,044

(22) Filed: Feb. 11, 2020

(65) Prior Publication Data

US 2020/0272091 A1 Aug. 27, 2020

(30) Foreign Application Priority Data

Feb. 22, 2019 (JP) ..... JP2019-030852
Nov. 8, 2019 (JP) ..... JP2019-203400

(51) Int. Cl.
*G03G 21/16* (2006.01)
*G03G 21/18* (2006.01)
*G03G 15/20* (2006.01)

(52) U.S. Cl.
CPC ..... *G03G 21/1685* (2013.01); *G03G 15/2035* (2013.01); *G03G 21/1638* (2013.01); *G03G 21/1864* (2013.01); *G03G 2221/1639* (2013.01); *G03G 2221/1654* (2013.01); *G03G 2221/18* (2013.01)

(58) Field of Classification Search
CPC ..... G03G 15/2035; G03G 21/1638; G03G 21/1685; G03G 21/1864; G03G 2221/1639; G03G 2221/1654; G03G 2221/18
See application file for complete search history.

(56) References Cited

U.S. PATENT DOCUMENTS

2004/0190939 A1* 9/2004 Yamanaka ..... G03G 15/2032 399/122
2005/0019053 A1* 1/2005 Ise ..... G03G 15/2017 399/90
2006/0140675 A1* 6/2006 Kim ..... G03G 21/1685 399/122
2007/0110475 A1 5/2007 Idehara et al.
2008/0185943 A1* 8/2008 Hirose ..... G03G 21/1633 312/237

(Continued)

FOREIGN PATENT DOCUMENTS

JP 1-274161 11/1989
JP 2003-177650 6/2003
JP 2007-164128 6/2007

*Primary Examiner* — Ryan D Walsh
(74) *Attorney, Agent, or Firm* — Xsensus LLP

(57) ABSTRACT

A fixing device includes a body and a cover. The body includes a roller and a positioning projection projecting from the body. The cover is supported on one end side in an axial direction of the roller and has a slot in which the positioning projection is inserted. The cover is configured to pivot on the positioning projection inserted in the slot, from a closed position to a retreated position from the body.

7 Claims, 6 Drawing Sheets

(56) References Cited

U.S. PATENT DOCUMENTS

| | | | | |
|---|---|---|---|---|
| 2008/0205914 | A1* | 8/2008 | Jeon | G03G 21/1638 399/21 |
| 2008/0219700 | A1* | 9/2008 | Saiki | G03G 21/1842 399/122 |
| 2008/0232847 | A1* | 9/2008 | Kusukawa | G03G 21/1671 399/114 |
| 2009/0060571 | A1* | 3/2009 | Kang | G03G 21/1685 399/122 |
| 2014/0153965 | A1* | 6/2014 | Nanno | G03G 21/1685 399/122 |
| 2014/0348542 | A1* | 11/2014 | Yoshida | G03G 15/2032 399/122 |
| 2019/0049891 | A1* | 2/2019 | Iikura | G03G 15/2028 |

* cited by examiner

FIXING DEVICE AND IMAGE FORMING APPARATUS INCORPORATING SAME

CROSS-REFERENCE TO RELATED APPLICATIONS

This patent application is based on and claims priority pursuant to 35 U.S.C. § 119(a) to Japanese Patent Application Nos. 2019-030852, filed on Feb. 22, 2019, and 2019-203400, filed on Nov. 8, 2019, in the Japan Patent Office, the entire disclosure of each of which is hereby incorporated by reference herein.

BACKGROUND

Technical Field

Embodiments of the present disclosure generally relate to a fixing device and an image forming apparatus incorporating the fixing device.

Related Art

In an electrophotographic image forming apparatus, when resolving paper jamming or performing maintenance of components, other components become obstacles depending on the configuration or component layout. Then, maintenance work is difficult and is not performed efficiently.

For example, in an image forming apparatus in which a sheet feeding passage is located below a fixing device, to resolve paper jamming, it is necessary to move the fixing device to open the sheet feeding passage. Due to such a complicated mechanism, the work is burdensome. The fixing device includes components to be replaced regularly. In an image forming apparatus in which the sheet feeding passage is located above the fixing device, the work for replacing the fixing device is complicated.

SUMMARY

According to an embodiment of this disclosure, a fixing device includes a body and a cover. The body includes a roller and a positioning projection projecting from the body. The cover is supported on one end side in an axial direction of the roller and has a slot in which the positioning projection is inserted. The cover is configured to pivot on the positioning projection inserted in the slot, from a closed position to a retreated position from the body.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
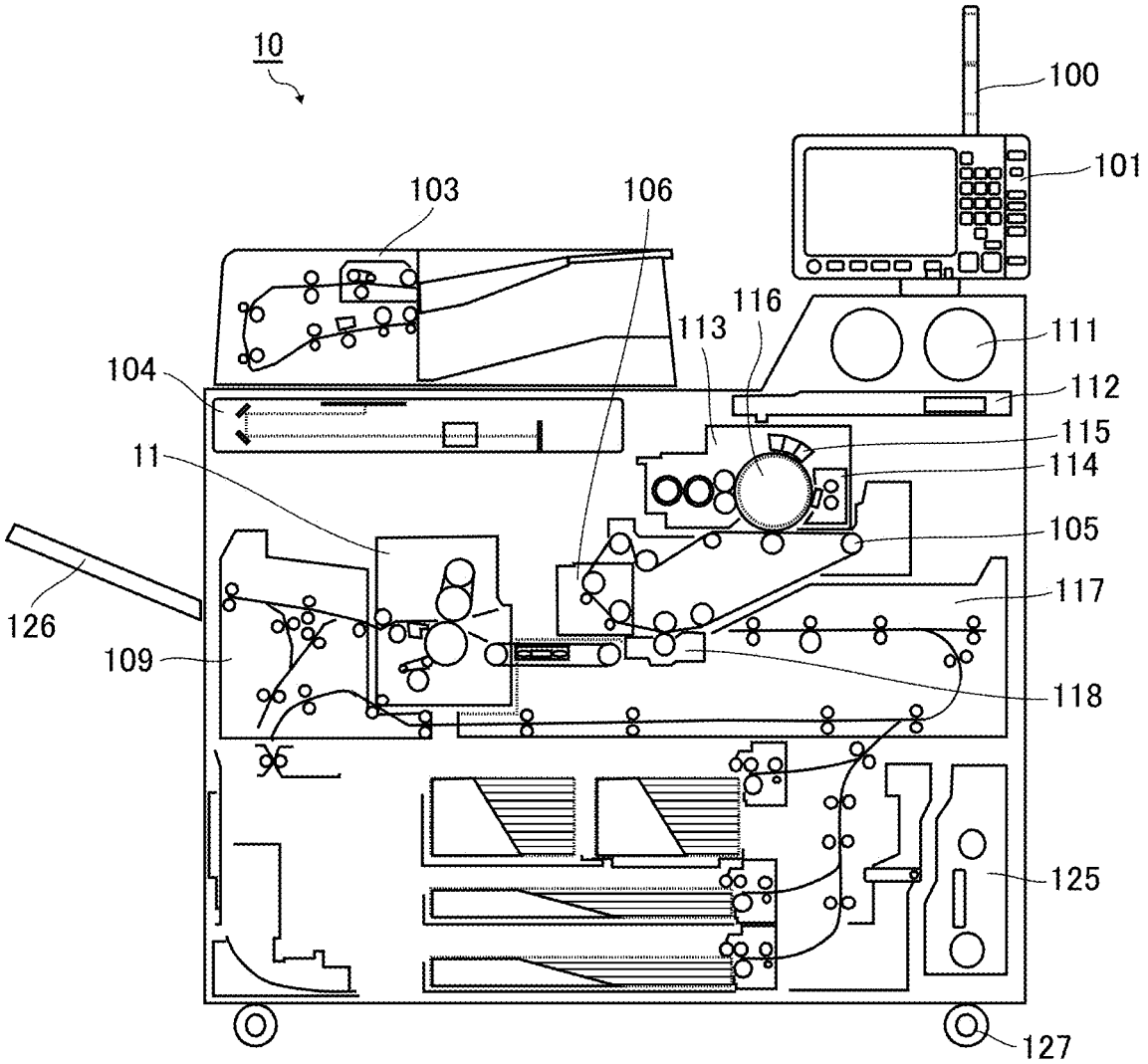
FIG. 1 is a schematic view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

Referring now to the drawings, wherein like reference numerals designate identical or corresponding parts throughout the several views thereof, embodiments of this disclosure are described. As used herein, the singular forms "a", "an", and "the" are intended to include the plural forms as well, unless the context clearly indicates otherwise.

A description is given of the image forming apparatus according to one embodiment of the present disclosure with reference to FIG. 1.

FIG. 1 is a schematic view illustrating an image forming apparatus 10, which in the present embodiment is a copier capable of monochrome image formation. The image forming apparatus 10 functions as a printer when connected to a computer such as personal computer (PC).

The image forming apparatus 10 according to the present embodiment is a copier and includes a document reading unit functioning as a scanner. However, the document reading unit may be omitted when a controller is built therein when the apparatus is dedicated to online output from computers, a so-called printer version.

Hereinafter, a schematic configuration and operation of the image forming apparatus according to the present embodiment are described.

The image forming apparatus 10 includes a scanner 104 accommodating an illuminating device, an optical system, a charge-coupled device (CCD) image sensor, and the like are housed.

An automatic document feeder (ADF) 103 is provided above the scanner 104. The ADF 103 automatically conveys a document to be read to a reading surface of an exposure glass (a platen).

An operator sets a document on the exposure glass on the upper side of the scanner 104 or the ADF 103 and selects a mode with a function selection key on a control panel 101.

Then, the operator sets desired image forming conditions while confirming contents displayed on a liquid crystal screen, with a numeric keypad and function keys. The image forming apparatus 10 includes a call light 100 that indicates an operation status to an operator.

Image data read by the scanner 104 is converted to image signals in analog-to-digital (A/D) conversion by a sensor board unit (SBU). Then, a laser writing unit 112 emits the image signals as laser light. The laser light is focused by a cylinder lens of the laser writing unit 112 and is deflected by a polygon mirror to linearly scan in the main scanning direction. Thus, the laser light forms an electrostatic latent image on a photoconductor drum 116.

Around the photoconductor drum 116, a developing unit 113, a cleaning unit 114, and a charger 115 are provided. The charger 115 charges the photoconductor drum 116.

A high voltage is applied to the charger 115 from a power supply unit (PSU) via a receptacle, an electrode terminal, a conductive bearing, and the like.

Toner is supplied as needed from a toner supply unit 111 (toner bottle) to the developing unit 113. The supplied toner and developer preliminarily stored in the developing unit 113 are transported to a developing roller while being stirred and mixed by a conveying screw inside the developing unit 113. The toner electrostatically attracted by the magnetic force is negatively charged.

The amount of the two-component developer carried on the developing roller is regulated by a magnetic brush regulator such as a doctor blade or a casing disposed below the developing roller. Then, the triboelectrically charged toner in the two-component developer moves onto the photoconductor drum 116 due to a bias voltage and selectively adheres thereto according to the electrostatic latent image.

A toner concentration sensor disposed at the bottom of the developing unit 113 detects the toner concentration inside the developing unit 113 from the charge amount. After the transfer, the toner remaining on the photoconductor drum 116 is scraped off by a cleaning blade in the cleaning unit 114, conveyed to a waste toner bottle 125, and collected therein.

An entrance seal made of mylar or sponge-like material is provided around the developing unit 113 to prevent the toner from scattering.

A visible image formed by the toner on the photoconductor drum 116 is temporarily transferred onto an intermediate transfer belt unit 105.

Meanwhile, a transfer sheet is conveyed by a sheet conveyance unit 117 and passes through a registration roller pair. When the transfer sheet passes a nip between the intermediate transfer belt unit 105 and a secondary transfer unit 118, The toner on the intermediate transfer belt unit 105 is transferred by a positive charge from a secondary transfer roller.

After the transfer, the toner remaining untransferred on the intermediate transfer belt unit 105 is scraped off by a cleaning blade in a belt cleaning unit 106, conveyed to the waste toner bottle 125, and collected therein.

A high voltage is applied to the transfer roller from the PSU via a receptacle, an electrode terminal, a conductive bearing, and the like.

In order to suppress fluctuations due to changes in the printing environment, the type of transfer sheet, and the like, the transfer bias is controlled in constant-current control, and the transfer current is appropriately switched according to the sheet feeding tray, transfer sheet size, sheet thickness, and the like.

Further, in order to prevent the transfer sheet from being stained by the toner adhering to the transfer roller, a negative bias can be applied to the transfer roller at a predetermined timing to return the toner to the intermediate transfer belt unit 105. Thus, the transfer roller is cleaned.

The transfer sheet to which the toner has been transferred is conveyed to a fixing device 11 (a fixing unit), where the toner image is fused and fixed on the paper by application of a certain heat and pressure.

The fixing roller in the fixing device 11 is provided with a thermistor to detect the surface temperature thereof, and on-off of a heater is controlled. The thermistor can be a contact type or a contactless type. Further, the fixing device 11 includes a thermal fuse to prevent an excessive temperature rise.

The fixing device 11 according to the present embodiment includes a heating roller, the fixing roller, a fixing belt stretched around the heating roller and the fixing roller, a pressure roller pressing against the fixing roller to form a nip between the fixing belt and the fixing roller, and the like. The pressure at the nip is controlled by a cam. The fixing device 11 further includes a cover to be described later.

The transfer sheet on which the toner image has been thermally fused is separated from the heating roller and the fixing belt by a fixing separating plate. Then, the transfer sheet passes through a reverse and ejection unit 109 and is ejected onto an output tray 126. Alternatively, after duplex printing according to set conditions, the transfer sheet is ejected.

In a system in which a post-processing apparatus or the like is coupled to the image forming apparatus, the transfer sheet is conveyed to a transfer sheet inlet of such an apparatus. The image forming apparatus 10 further includes a caster 127 for moving the main body.

The image forming apparatus 10 according to the present embodiment forms an image by electrophotography with the above-described configuration and operation.

Next, the fixing device according to the present disclosure will be described with reference to FIGS. 2 to 9.

Figure 2:
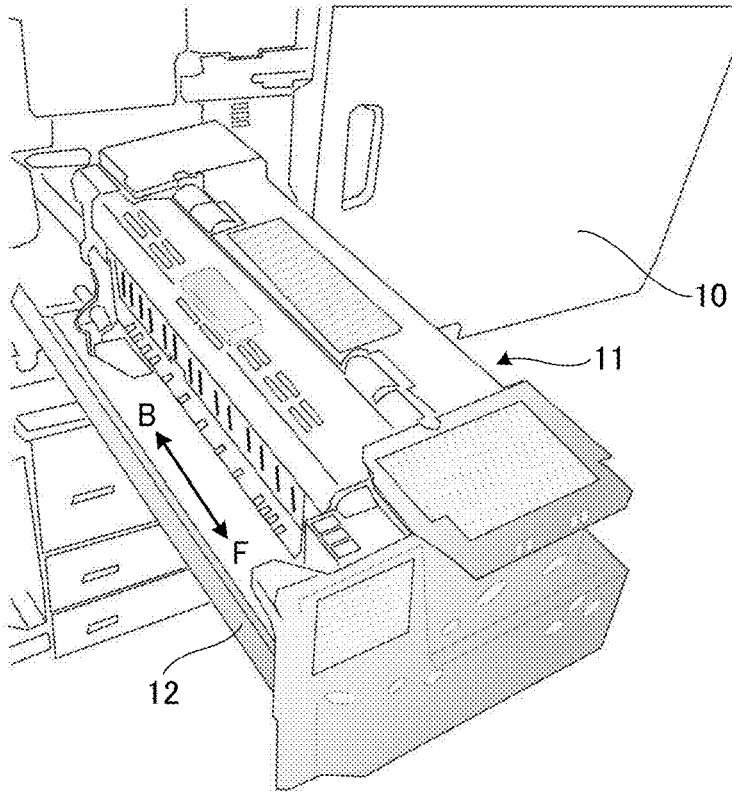
FIG. 2 is a schematic perspective view illustrating a fixing device according to an embodiment of the present disclosure, mounted on the image forming apparatus illustrated in FIG. 1.

As illustrated in FIG. 2, the fixing device 11 according to the present embodiment is mounted on a slide rail 12 inside the image forming apparatus 10 and can be pulled out of the image forming apparatus 10. The arrow in the figure indicates the pull-out and retraction direction of the fixing device 11. The fixing device 11 is pulled out to a front side (or near side) given reference "F" and retracted to a back side given reference "B", which is the rear side of the image forming apparatus 10.

Figure 3:
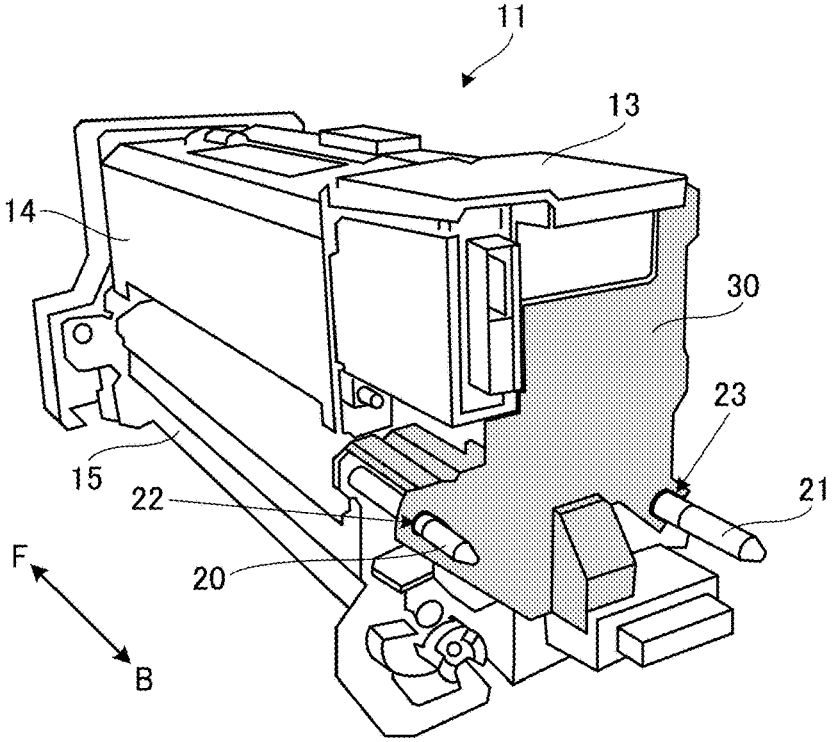
FIG. 3 is a schematic perspective view illustrating an external appearance of the fixing device illustrated in FIG. 2.

FIG. 3 illustrates the fixing device 11 detached from the slide rail 12 illustrated in FIG. 2, as viewed from the back side.

The fixing device 11 according to the present embodiment illustrated in FIG. 3 includes a cover 30 on the back side (the image forming apparatus rear side) in the direction in which the fixing device 11 is pulled out on the slide rail 12. The cover 30 rotates (pivots) to open the rear side of the fixing device 11 in the pull-out direction.

The description below concerns the fixing device 11 including the cover 30 disposed on the back side in the pulling-out direction, but the cover 30 can be disposed on the front side or both of the front side and the back side in the pulling-out direction.

Figure 4:
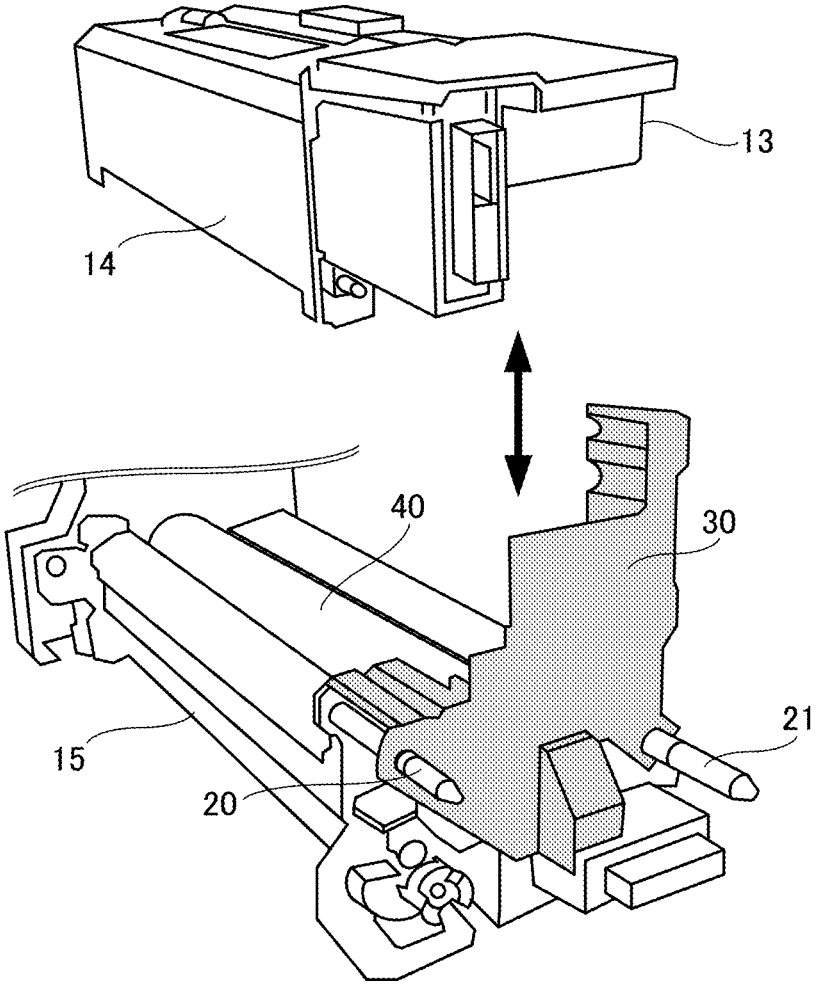
FIG. 4 is a perspective exploded view schematically illustrating a state in which the fixing device is divided into upper and lower units.

As illustrated in FIG. 4, the fixing device 11 according to the present embodiment is divided into an upper unit, which includes a separation unit 13 and a heating unit 14, and a lower unit (main body), which includes a pressure unit 15. The pressure unit 15 includes a pressure roller 40.

Figure 6:
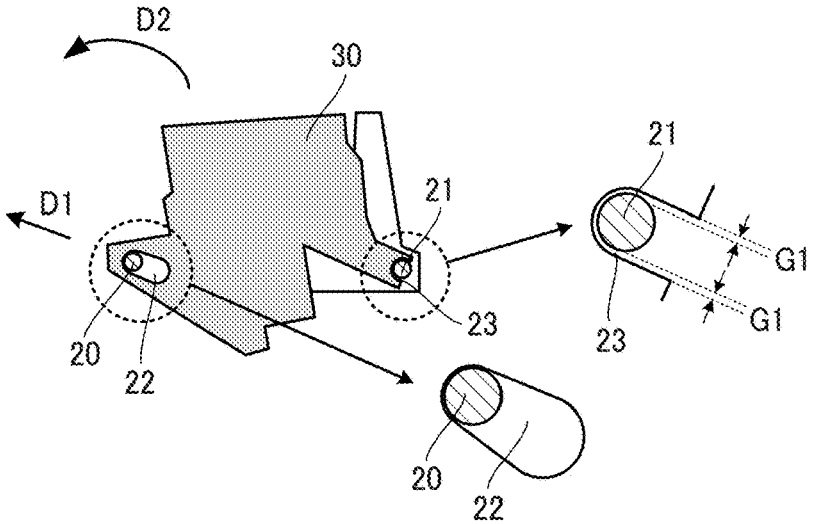
FIG. 6 is a schematic front view of the fixing device with the cover closed, together with partial enlarged views.

FIG. 6 is a schematic front view of the pressure unit 15 illustrated in FIG. 4.

As illustrated in FIGS. 4 and 6, in the fixing device 11 according to the present embodiment, the cover 30 is rotatably supported at an axial end of the pressure roller 40. The cover 30 rotates to open and close with respect to the fixing device 11. The cover 30 includes a slot 22 (a long opening) in which a positioning projection 20 projecting from the pressure unit 15 is inserted. The cover 30 rotates around (pivots on) the positioning projection 20 in the slot 22.

In the present embodiment, the cover 30 is rotated and retreated from the pressure unit 15 so as to open the back side of the fixing device 11 in the pull-out direction. Thus, it is not necessary to detach and attach the cover 30 from and to the fixing device 11.

Such a configuration can improve the efficiency in maintenance work of the fixing device 11 and prevent damage or loss due to the attaching and detaching of the cover 30.

Since the fixing device 11 can be exposed to a high temperature of about 300° C. depending on the position, the material of the cover 30 is preferably a heat-resistant resin from the viewpoint of safety of the operator.

The cover 30 according to the present embodiment is made of a thermoplastic polyester resin, specifically, a material in which glass fibers are uniformly mixed in polyethylene terephthalate (PET).

Examples of the material of the cover 30 include polyacetal (POM), polyamide (PA), polycarbonate (PC), modified polyphenylene ether (m-PPE), and polybutylene terephthalate (PBT).

The slot 22 of the cover 30 is shaped like a long hole in which the inserted positioning projection 20 (first reference pin) can move in the major axis direction of the slot 22. The width (minor axis length) of the slot 22 is not uniform. The opening diameter (in the minor axis direction) of the slot 22 increases from a first end (left end in FIG. 6) that abuts on the positioning projection 20 when the cover 30 is closed, toward the second end opposite the first end.

At the position where the cover 30 is closed (normal position or set position), the first end side of the slot 22 is in contact with the positioning projection 20, and the first end side has substantially the same diameter as the diameter of the positioning projection 20. Accordingly, the cover 30 is reliably positioned and secured. On the other hand, the opening diameter increases toward the other end side and becomes larger than the diameter of the positioning projection 20. Accordingly, the rotation and retreat of the cover 30 can be smooth.

The cover 30 further has a notch-shaped recess 23. In state where the cover 30 is at the closed position illustrated in FIGS. 4 and 6, the recess 23 engages with a support member 21 (second reference pin) that is a projection on the main body side of the fixing device 11. The recess 23 engages with the support member 21 to restrict the rotation of the cover 30. The recess 23 is open on one side in the major axis direction (arrow D1) of the slot 22.

The cover 30 can be reliably positioned and secured at the normal position by the engagement between the support member 21 and the recess 23 in addition to the engagement between the positioning projection 20 and the slot 22.

The engagement between the support member 21 and the recess 23 is released as the cover 30 is moved in the direction illustrated by arrow D1 in FIG. 6 so that the positioning projection 20 slides in the slot 22. Then, the cover 30 can rotate and retreat in the direction indicated by arrow D2.

As illustrated in FIG. 6, the width of the recess 23 includes a clearance G1 that allows the support member 21 to move in the recess 23. That is, the width of the recess 23 perpendicular to the axis of the support member 21 is greater than the diameter of the support member 21. With the clearance G1, the movement of the cover 30 in the direction indicated by arrow D1 becomes smoother.

Figure 5:
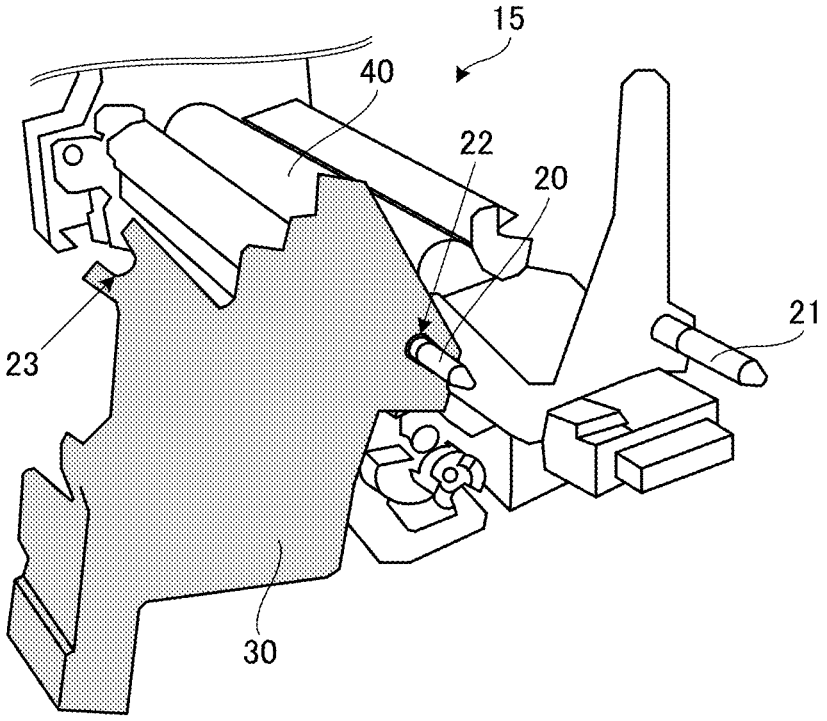
FIG. 5 is a perspective view schematically illustrating a state in which a cover of the fixing device is rotated and retreated.
Figure 7:
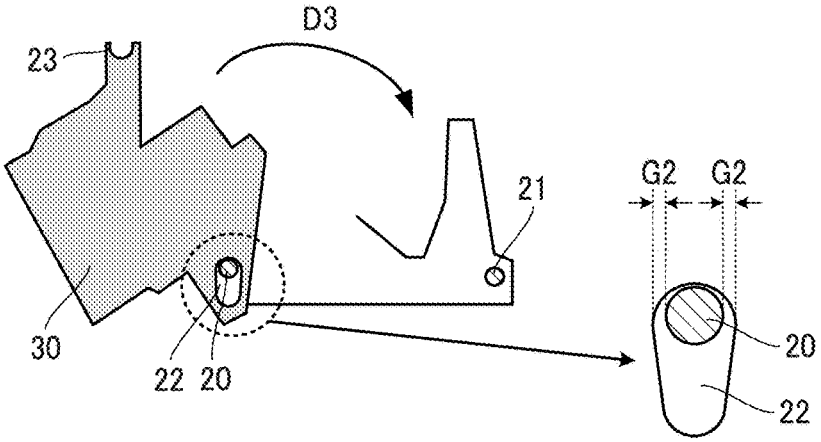
FIG. 7 is a schematic front view of the fixing device with the cover rotated, together with partial enlarged views.

FIGS. 5 and 7 illustrate a state in which the cover 30 is rotated and retreated, exposing the end face of the pressure roller 40 (on the back side in the pull-out direction). FIG. 7 is a schematic front view of the state illustrated in FIG. 5.

As illustrated in FIG. 7, when the cover 30 is at the retreated position, the second end of the slot 22 contacts the positioning projection 20. The diameter of the second end side of the slot 22 is larger, and a clearance G2 is secured between the positioning projection 20.

The fixing device 11 according to the present embodiment includes a drive gear train 41 (see FIG. 9) to drive the pressure roller 40. The direction (indicated by arrow D2 in FIG. 6) in which the cover 30 rotates to retreat is a direction retreating from the drive gear train 41.

Figure 9:
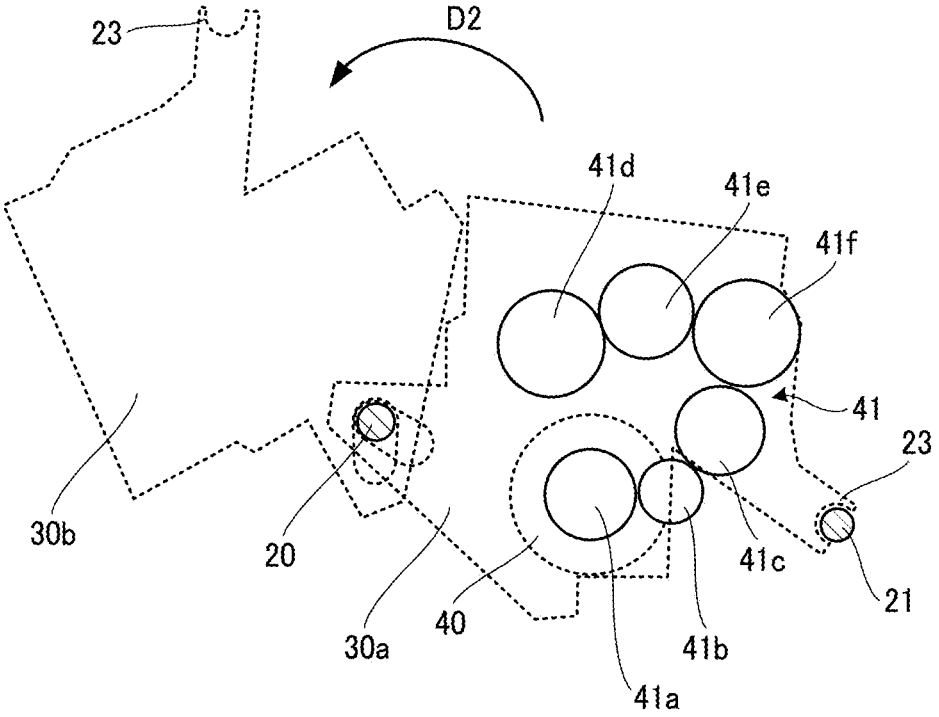
FIG. 9 is a schematic diagram illustrating an example of a drive gear train of a roller according to an embodiment.

FIG. 9 illustrates an example of the arrangement of the drive gear train 41. In the figure, the positioning projection 20 (first reference pin) and the projecting support member 21 (second reference pin) are illustrated for understanding of the positional relationship of the drive gear train 41, and a normal position 30*a* (before rotation) and a retreated position 30*b* (after rotation) of the cover 30 are illustrated by broken lines. The pressure roller 40 is provided with a drive gear 41*a*, and an idler gear 41*b* and an input gear 41*c* are disposed on the support member 21 side of the drive gear 41*a*. The drive gear train 41 further includes a drive gear 41*d* for the fixing roller and idler gears 41*e* and 41*f* for the fixing roller.

Since the direction indicated by arrow D2, in which the cover 30 pivots from the normal position 30*a* to the retreated position 30*b*, is the direction retreating from the drive gear train 41 (the direction toward the opposite side of the drive gear train 41), the efficiency in maintenance work improves.

Further, as the cover 30 rotates in this direction, the recess 23 of the cover 30 moves to a position separate from a drawer connector or an obstacle such as an upper face of a workbench. Thus, damage can be prevented.

A fixing device according to another embodiment is described with reference to FIGS. 8A and 8B.

Figure 8A:
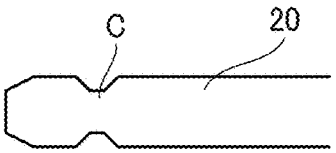
FIG. 8A is a schematic cross-sectional view of a positioning projection for the cover, according to an embodiment.
Figure 8B:
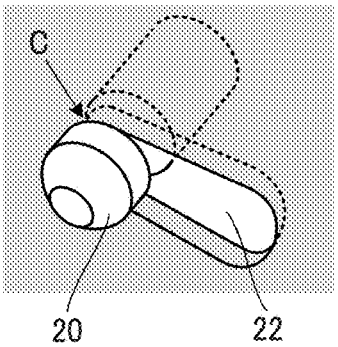
FIG. 8B is a perspective view of the positioning projection illustrated in FIG. 8A.

FIG. 8A is a schematic cross-sectional view of the positioning projection 20 (first reference pin) of the fixing device according to another embodiment, and FIG. 8B is a perspective view schematically illustrating the positioning projection 20 (first reference pin) inserted in the slot 22.

As illustrated in FIGS. 8A and 8B, the positioning projection 20 of the fixing device according to the present embodiment has a constricted portion C different (reduced) in area in cross section perpendicular to the longitudinal direction from other portions of the positioning projection 20. The slot 22 of the cover 30 has a long hole shape in which the constricted portion C of the positioning projection 20 can move in the slot 22 in the major axis direction. The opening diameter (width perpendicular to the major axis) of the slot 22 increases from the first end that abuts on the constricted portion C when the cover 30 is closed, toward the second end opposite the first end. The diameter of the cross section of the positioning projection 20 other than the constricted portion C is slightly larger than the maximum diameter of the slot 22.

In the present embodiment, since the diameter of the cross-sectional area of the positioning projection 20 other than the constricted portion C is slightly larger than the maximum diameter of the slot 22, to insert the positioning projection 20 into the slot 22 of the cover 30, the constricted portion C is fitted in the slot 22 by forcing the positioning projection into the cover 30. Attaching the cover 30 in this manner can prevent the cover 30 from falling off during the rotation and retreating. Further, the cover 30 can be easily attached and detached without using a tool.

The cover 30 is preferably made of resin, and plastic deformation of the resin enables such a manner of attaching.

An example of a maintenance work (for example, replacement of a component) of the above-described fixing device is described.

First, after the printing operation of the image forming apparatus 10 illustrated in FIG. 2 stops, the operator pulls out the fixing device 11 (fixing unit) mounted on the slide rail 12. Preferably, the fixing device 11 is pulled out after being sufficiently cooled.

Next, the operator detaches the fixing device 11 from the slide rail 12, places the fixing device 11 on a workbench, and starts the maintenance work.

The fixing device 11 according to the present embodiment can be vertically divided into the upper unit (the separation unit 13 and the heating unit 14) and the pressure unit 15 as illustrated in FIG. 4 when a fastening screw combining the units is removed.

After dividing the fixing device 11 into units, the operator performs the maintenance of the target unit. For example, the maintenance work of the pressure roller 40 of the pressure unit 15 includes replacement of the heater such as a halogen heater or the like. At this time, since the cover 30 becomes an obstacle to the operation, the cover 30 is pivoted and retreat to the position illustrated in FIGS. 5 and 7.

Without detaching the cover 30 from the fixing device 11, the operator pivots the cover 30 with the positioning projection 20 remaining in the slot 22 and retreats the cover 30 to the position not obstructing the maintenance work.

The cover 30 being at the closed position is secured with the recess 23 engaging with the support member 21. As the operator slides the positioning projection 20 along the slot 22 in the direction indicated by arrow D1 (see FIG. 6), the recess 23 is disengaged from the support member 21. Then, the cover 30 is rotatable in the direction indicated by arrow D2.

After the maintenance work is completed, the operator rotates the cover 30 in the direction indicated by arrow D3 in FIG. 7, which is opposite to the retreat direction indicated by arrow D2. The operator then fits the recess 23 with the support member 21 to be secured, and returns the cover 30 to the closed position (normal position). Then, the operator places the fixing device 11 in which the units are combined on the slide rail 12 and retracts the fixing device 11 into the image forming apparatus 10.

The above-described method can improve the work efficiency of the maintenance of the fixing device 11.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure. Any aspects having advantages as described in the following embodiments according to the present disclosure are included within the scope of the present disclosure.

What is claimed is:

1. A fixing device comprising:

a body including:

a roller; and a positioning projection projecting from the body; and a cover supported on one end side in an axial direction of the roller, the cover having a slot in which the positioning projection is disposed, the cover configured to pivot on the positioning projection disposed in the slot, from a closed position to a retreated position from the body, wherein the slot is configured to allow the positioning projection to move in the slot in a major axis direction of the slot, wherein a first end of the slot in the major axis direction contacts the positioning projection in a state where the cover is closed, and wherein a width of the slot perpendicular to the major axis direction increases from the first end toward a second end opposite the first end.

2. The fixing device according to claim 1, further comprising:

a drive gear train for the roller, wherein a direction in which the cover pivots to the retreated position is a direction retreating from the drive gear train.

3. The fixing device according to claim 1, wherein the positioning projection includes a constricted portion having a reduced area on a cross section perpendicular to a longitudinal direction of the positioning projection, wherein the slot of the cover is configured to allow the constricted portion of the positioning projection to move in the slot in the major axis direction of the slot, wherein the first end of the slot in the major axis direction contacts the constricted portion when the cover is at the closed position, wherein a diameter of a cross section of the positioning projection other than the constricted portion is slightly larger than a maximum width of the slot.

4. The fixing device according to claim 1, wherein the fixing device is configured to be mounted on a slide rail of an image forming apparatus to be pulled out from and retracted into the image forming apparatus, and wherein the cover is on a back side of the fixing device in a pull-out direction of the fixing device and configured to pivot to open the back side of the fixing device.

5. An image forming apparatus comprising the fixing device according to claim 1.

6. A fixing device comprising:

a body including:

a roller; and a positioning projection projecting from the body; and a cover supported on one end side in an axial direction of the roller, the cover having a slot in which the positioning projection is disposed, the cover configured to pivot on the positioning projection disposed in the slot, from a closed position to a retreated position from the body, wherein the body includes a projecting support, wherein the cover has a notch-shaped recess configured to engage with the projecting support of the body in a state where the cover is closed, and wherein engagement between the recess and the projecting support restricts pivoting of the cover.

7. The fixing device according to claim 6, wherein a width of the recess of the cover is greater than a width of the projecting support to secure a clearance for the projecting support to move inside the recess.

* * * * *